United States Patent [19]

Dumont et al.

[11] 4,252,578

[45] Feb. 24, 1981

[54] PROCESS FOR THERMAL TREATMENT OF TUBES

[75] Inventors: Michel Dumont; Joseph Huot; Pierre Huot, all of Montbard, France

[73] Assignee: Vallcurec (Usines a Tubes de Lorraine-Escaut et Vallourec Reunies), Par is, France

[21] Appl. No.: 10,837

[22] Filed: Feb. 9, 1979

[30] Foreign Application Priority Data

Feb. 14, 1978 [FR] France ..... 78 04123

[51] Int. Cl.[3] ..... C21D 9/08

[52] U.S. Cl. ..... 148/131; 148/36; 148/37

[58] Field of Search ..... 148/127, 131, 154, 32, 148/36, 37, 38

[56] References Cited

U.S. PATENT DOCUMENTS

| | | | |
|---|---|---|---|
| 1,570,815 | 1/1926 | Wylie | 148/154 |
| 1,727,192 | 9/1929 | Baily | 148/13 |
| 2,066,515 | 1/1937 | Bishop | 148/131 |

*Primary Examiner*—R. Dean

*Attorney, Agent, or Firm*—Brisebois & Kruger

[57] ABSTRACT

Elongated steel tubes are grouped together and bound into bundles with binding sufficiently tight that there is no clearance or play between the tubes during heat treatment. Such binding provides a rigid mechanical assembly which prevents any lateral deformation of the tubes with respect to each other. Heat treatment is carried out while the tubes are tightly bound in bundles, and each bundle is supported in the furnace at least at several locations along its length to prevent deformation. The bundles are preferably of hexagon shape in section but can be of other geometric shapes. This technique results in heat treated tubes which are perfectly straight.

7 Claims, 6 Drawing Figures

PROCESS FOR THERMAL TREATMENT OF TUBES

The present invention relates to a process for heat treating metal tubes, especially steel tubes, and to the tubes obtained by this process.

The process may be applied to many types of tubes but is particularly advantageous for very long, small diameter or thin tubes.

BACKGROUND OF THE INVENTION

In the processes for manufacturing very long, thin tubes to be used, for example, in heat exchangers, or other thermal installations, in general the tubes obtained after various mechanical operations are subjected to a final heat treatment in a furnace at a specified temperature for a specified time. At the time of the thermal treatment the tubes are generally stacked in piles between lateral supports to permit a large number of tubes to be treated at the same time. Experience has shown that when the tubes leave the furnace following this thermal treatment they are no longer rectilinear or straight even if they were trued and straightened before going into the furnace, this loss of straightness being due to creep phenomena during the thermal treatment.

SUMMARY OF THE INVENTION

The present invention proposes to remedy these disadvantages and to provide a process for heat treatment of tubes yielding, at the end of the thermal treatment, perfectly rectilinear or straight tubes. The invention also proposes to obtain this result in a particularly simple manner without modifying either the furnaces or the heat treatment process itself.

The object of the invention is a process for the thermal treatment of metal tubes, especially steel tubes, and particularly thin or small diameter tubes of great length, in which the tubes undergo the heat treatment while stacked inside a furnace, characterized by the fact that one forms one or a plurality of bundles of tubes stacked in a regulated fashion and maintained in their bundles by means sufficiently closely spaced along the length of a bundle to prevent any lateral play or flection of one tube with respect to the other, the bundles so formed being so placed in the furnace that the tubes are perfectly rectilinear at the end of the placement, each bundle thus forming a mechanical assembly preventing any deformation of the tubes.

The number of tubes in a bundle should be at least 7 and preferably more, for example, bundles of 61, 91 or 225 tubes.

In one preferred embodiment of the invention the tubes are held by binding means, for example, thin-bands or hoops made of a steel having a predetermined thermal expansion coefficient.

Of course the bundles are placed on supports in the furnace sufficiently closely spaced to avoid flection or deformation of the unsupported areas of a bundle between supports.

It must be understood that conforming to the invention the bundles of tubes are made so as to constitute a form of mechanical assembly in which each tube loses its individuality and in particular is unable to move laterally or radially with respect to its neighboring tubes.

According to one particularly preferred embodiment of the invention, the bundles are made so as to have a hexagonal section or one based on a hexagon. The hexagon can be completely filled or one, preferably central, region of the hexagon can be left empty provided means are furnished to support the tubes surrounding such a region.

Among the possible shapes related to a hexagon are truncated hexagons or trapezoids in which the inclined sides have a slope corresponding to the slopes of the hexagon.

Other geometric shapes can also be used for the section of the bundle, for example, squares or rectangles, but experience has shown, surprisingly, that bundles of hexagonal shape yield clearly better results in maintaining the straightness of the tubes.

Preferably, tubes will be used which are initially rectilinear, for example, following a truing up or straightening operation but the process according to the invention can also be applied to tubes having stresses provided that the tubes are sufficiently yieldable or deformable to be formed or incorporated into perfectly rectilinear bundles.

Another object of the present invention is the tubes obtained by the above process.

In the case of extremely long, thin tubes of relatively small diameter, a straight tube obtained by the present invention is understood to mean a tube which, when placed in rectilinear fashion, for example, on the ground, retains this rectilinear or straight position spontaneously. Such rectilinear tubes must be distinguished from thin, non-recilinear tubes which can, by appropriate means, be forced to remain straight because of their thinness and their great length.

Other advantages and characteristics of the invention will become clear upon reading the following description, which is a non-limiting example, and with reference to the attached drawings:

BRIEF DESCRIPTION OF THE DRAWINGS

FIG. 1 shows a bundle of stainless steel tubes 1. Each tube has an outside diameter of about 20 mm, a wall thickness of about 1 mm and a length of about 30 meters. These tubes were made by rolling and have undergone finishing operations.

Figure 1:
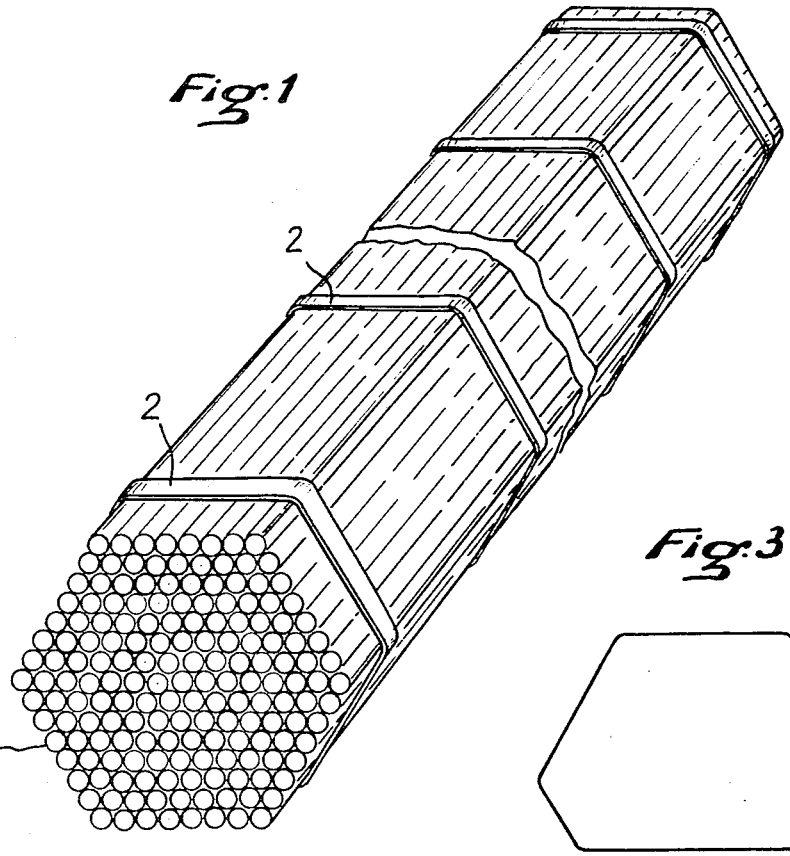
FIG. 1 shows a perspective view of a bundle of tubes for heat treating according to the invention.

The tubes are prepared in bundles of hexagonal section and each base of the hexagon includes 8 tubes. As may be seen, the tubes are perfectly stacked to form a honeycomb type structure.

The tubes may advantageously be stacked in a form into which the tubes 1 are fed one after the other so that they naturally take up their positions. The tubes are then bound with steel bands 2 having a predetermined coefficient of thermal expansion, this binding being very tightly done to avoid any possibility of play or clearance between adjacent tubes. One band 2 is placed every 1.5 m. One then obtains the bundle with a hexagonal section shown in FIG. 1 and this bundle is then placed in a conventional furnace. At the time of placement in the furnace care is taken to assure that the bundle lies in a perfectly rectilinear fashion in the furnace. The bundle can be placed on spaced apart supports, provided that the supports are close enough together, say 0.6 meters apart, to avoid a flection or deformation of the bundle between two consecutive support points.

The bundle of tubes is then heat treated in the furnace by heating at 700° to 900° for several hours.

When, at the end of the heat treatment, the bundle of tubes is removed from the furnace and the tubes are separated by opening the bundle, it will be seen that the tubes are perfectly rectilinear, that is, each tube when placed in a rectilinear position holds that position spontaneously.

By comparison the same tubes placed in a perfectly rectilinear fashion in a furnace in a conventional pile will show curvatures when removed from the furnace.

Figure 2:
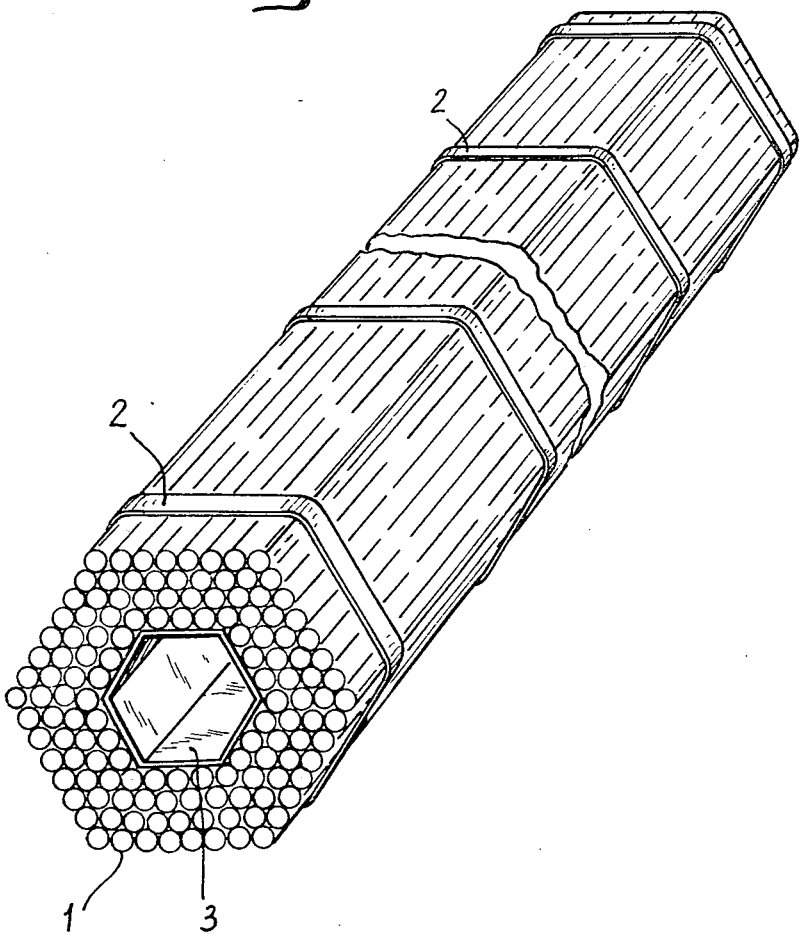
FIG. 2 shows a schematic perspective view of another form of tube bundle.

FIG. 2 shows a hexagonal bundle of tubes similar to that of FIG. 1 but having in its center a hollow tubular core 3 of hexagonal section around which four layers of tubes 1 are positioned. This bundle has the same rigidity as the bundle of FIG. 1. Because of the central passage provided by the hollow core 3, more rapid and uniform heating occurs during the heat treatment.

In another test, an identical heat treatment was carried out on a bundle of tubes of square section in which each tube is in direct contact with only four adjacent tubes instead of with six tubes as in the hexagonal bundle. The bundle is very tightly bound with very high pressure. The test shows that the tubes treated in bundles are fairly straight at the end of the treatment, their straightness being clearly superior to that of tubes treated in piles according to the prior art. However, the degree of straightness of each individual tube is less than that obtained by treatment in bundles of hexagonal section.

Figure 3:
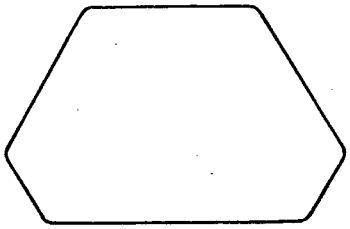
FIGS. 3 to 6 schematically show end views of other shapes of bundles.
Figure 4:
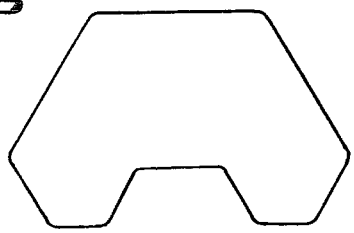

Of course the section of the hexagonal bundles may vary and the other figures show different possible shapes. Thus FIG. 3 shows a partial truncated hexagonal section. FIG. 4 shows a more complex shape including a recess.

Figure 5:
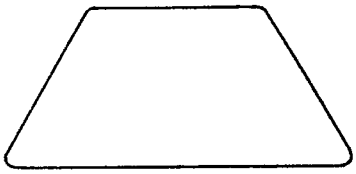

FIG. 5 shows a trapezoidal section in which the inclinations of the sides correspond to the inclinations of the corresponding sides of a hexagon.

Figure 6:
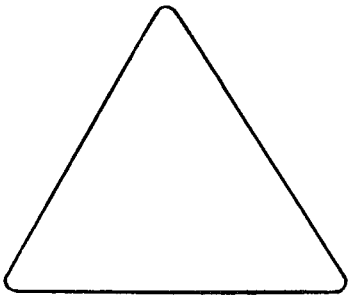

FIG. 6 shows a bundle with a section shaped like an equilateral triangle, but such a configuration is not preferred because it yields poorer results than a hexagonal section.

Of course other different variations of such sections can be envisioned, preferably variations in which most of the tubes are in contact with six other tubes.

Although one particular embodiment of the invention has been described, it is of course in no way limiting and various modifications may be made without departing from either the scope or the principles of the invention.

What is claimed is:

1. A process of heat treating metal tubes, particularly of steel comprising arranging a multiplicity of elongated tubes in a group with the axes of the tubes generally parallel with each other, tightly binding the tubes together in a bundle with metal binding means extending around the group of tubes at least at several spaced apart distinct locations along the length of the bundle prior to heat treating.

heat treating the bundle of tubes by heating the bundle in a furnace while maintaining the tubes bound together with the metal binding means to prevent deformation of the tubes, and removing the tubes from the furnace.

2. A process according to claim 1 wherein said step of binding the tubes together comprises binding the tubes together to form a bundle of a shape derived from a hexagon.

3. A process according to claim 1 wherein said step of binding the tubes together comprises binding the tubes together to form a hexagonal bundle.

4. A process according to claim 1 wherein said multiplicity of tubes comprises at least seven tubes.

5. A process according to claim 1 further comprising supporting said bundle in said furnace at plural locations along the length of the bundle sufficiently close to each other to prevent flection of the group of tubes in the bundle during heat treating.

6. A process according to claim 1 wherein said step of binding the tubes together to form said bundle comprises binding the tubes together with metal bands at spaced apart locations along the length of the bundle.

7. A process according to claim 1 wherein said tubes comprise steel tubes, and said step of binding with metal bands comprises binding said bundle with steel bands having a predetermined coefficient of thermal expansion.

* * * * *